US011261582B1

(12) United States Patent
Andreuccetti et al.

(10) Patent No.: US 11,261,582 B1
(45) Date of Patent: Mar. 1, 2022

(54) SYSTEM AND METHOD FOR CONTROLLING HYDRAULIC FLUID FLOW WITHIN A WORK VEHICLE USING FLOW CONTROL VALVES

(71) Applicant: CNH Industrial America LLC, New Holland, PA (US)

(72) Inventors: Christopher Alan Andreuccetti, Burlington, IA (US); Francesco Pintore, Modena (IT); Stefano Fiorati, Ferrara (IT); Jason David Fox, Tucson, AZ (US); Andrea Vacca, West Lafayette, IN (US); Riccardo Madau, Turin (IT)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 17/162,237

(22) Filed: Jan. 29, 2021

(51) Int. Cl.
*F15B 11/16* (2006.01)
*E02F 9/22* (2006.01)

(52) U.S. Cl.
CPC ..... *E02F 9/2228* (2013.01); *E02F 9/2235* (2013.01); *E02F 9/2296* (2013.01); (Continued)

(58) Field of Classification Search
CPC ..... F15B 11/161; F15B 11/162; F15B 11/163; F15B 11/165
See application file for complete search history.

(56) References Cited

U.S. PATENT DOCUMENTS 3,987,622 A 10/1976 Johnson
4,796,661 A 1/1989 Hishinuma et al.
(Continued)

FOREIGN PATENT DOCUMENTS

EP 2320094 5/2011
EP 3076028 10/2016

OTHER PUBLICATIONS

Massimo et al., "Energy Saving in the Hydraulic Circuit for Agricultural Tractors: Focus on the Power Supply Group", Scientific Proceedings XXIII International Scientific-Technical Conference, Dated Jun. 30, 2015 (7 pages) https://trans-motauto.com/sbornik/2015/1/08.ENERGY%20SAVING%20IN%20THE%20HYDRAULIC%20CIRCUIT%20FOR%20AGRICULTURAL%20TRACTORS%20-%20FOCUS%20ON%20THE%20POWER%20SUPPLY%20GROUP.pdf.
(Continued)

*Primary Examiner* — Michael Leslie
(74) *Attorney, Agent, or Firm* — Rickard K. DeMille; Rebecca L. Henkel

(57) ABSTRACT

A system for controlling hydraulic fluid flow within a work vehicle includes a flow control valve fluidly coupled to a fluid supply conduit upstream of a hydraulic actuator such that the flow control valve is configured to control the flow rate of hydraulic fluid to the hydraulic actuator. Furthermore, the system includes a computing system configured to receive an input associated with a selected flow rate of the hydraulic fluid being supplied to the hydraulic actuator. Moreover, the computing system is configured to control an operation of the flow control valve such that flow control valve is at a maximum flow position at which an adjustable orifice defined by the valve has a maximum cross-sectional area. Additionally, the computing system is configured to control an operation of a pump such that the pump supplies the hydraulic fluid to the hydraulic actuator through the adjustable orifice at the selected flow rate.

6 Claims, 7 Drawing Sheets

(52) U.S. Cl.
CPC ..... *F15B 11/162* (2013.01); *F15B 11/163* (2013.01); *F15B 11/165* (2013.01)

(56) References Cited

U.S. PATENT DOCUMENTS

| | | | | |
|---|---|---|---|---|
| 5,347,811 | A * | 9/1994 | Hasegawa | F15B 11/163 60/426 |
| 5,579,642 | A | 12/1996 | Wilke et al. | |
| 5,907,951 | A | 6/1999 | Toyooka et al. | |
| 6,179,570 | B1 | 1/2001 | Smith | |
| 6,318,079 | B1 | 11/2001 | Barber | |
| 6,422,009 | B1 * | 7/2002 | Nozawa | F15B 11/165 60/447 |
| 6,644,025 | B1 * | 11/2003 | Oberhausser | F15B 11/163 60/422 |
| 6,895,852 | B2 | 5/2005 | Pieper | |
| 7,275,370 | B2 * | 10/2007 | Hesse | F15B 11/165 60/445 |
| 7,434,393 | B2 * | 10/2008 | Hesse | F15B 11/165 60/422 |
| 7,481,051 | B2 | 1/2009 | Bergquist | |
| 7,854,115 | B2 | 12/2010 | Pack et al. | |
| 8,869,520 | B2 * | 10/2014 | Vigholm | F15B 11/165 60/422 |
| 9,091,281 | B2 | 7/2015 | Quinnell et al. | |
| 9,200,646 | B2 | 12/2015 | Weickert et al. | |
| 9,429,175 | B2 | 8/2016 | Coolidge | |
| 9,506,222 | B2 | 11/2016 | Britten et al. | |
| 9,506,480 | B2 | 11/2016 | Hiraku et al. | |
| 9,759,212 | B2 | 9/2017 | Lingenfelter et al. | |
| 10,024,342 | B2 * | 7/2018 | Terao | F15B 11/163 |
| 10,184,228 | B2 | 1/2019 | Ito et al. | |
| 10,260,531 | B2 | 4/2019 | Kondo et al. | |
| 10,323,458 | B2 | 6/2019 | Chiaramonte et al. | |
| 10,378,184 | B2 | 8/2019 | Vigholm | |
| 10,392,780 | B2 | 8/2019 | Sugano et al. | |
| 2008/0295508 | A1 | 12/2008 | Ma et al. | |
| 2010/0307606 | A1 | 12/2010 | Russell et al. | |
| 2013/0280097 | A1 | 10/2013 | Narotham | |
| 2015/0027112 | A1 | 1/2015 | Takebayashi et al. | |
| 2016/0032566 | A1 | 2/2016 | Taddia et al. | |
| 2017/0274930 | A1 | 9/2017 | Zhang et al. | |
| 2019/0177952 | A1 | 6/2019 | Ito et al. | |
| 2021/0131455 | A1 * | 5/2021 | Szeles | F15B 11/162 |

OTHER PUBLICATIONS

Olpp, "Limiting the Local Pressure in Post-Compensated Valves", Bucher Hydraulics, Dated Nov. 6, 2017 (2 pages) https://www.bucherhydraulics.com/50862/NewsBlog/Overview/HDS24/blog.aspx.

"Energy Dissipating Solutions", Ross Valve brochure, Dated Sep. 5, 2019 (6 pages) http://aftinc.com/pdf/WWF-Valves-EnergyDissipating-Ross.pdf.

"Sleeve—Energy Dissipating Valve" Specifications, Henry Pratt Company, Mueller Water Products, Inc., Dated 2019 (2 pages) https://www.henrypratt.com/products/energy-dissipating-valves/sleeve/sleeve/.

* cited by examiner

SYSTEM AND METHOD FOR CONTROLLING HYDRAULIC FLUID FLOW WITHIN A WORK VEHICLE USING FLOW CONTROL VALVES

FIELD OF THE INVENTION

The present disclosure generally relates to work vehicles and, more particularly, to systems and methods for controlling hydraulic fluid flow within a work vehicle using flow control valves.

BACKGROUND OF THE INVENTION

A work vehicle, such as a wheel loader, skid steer loader, backhoe loader, compact track loader, and the like, typically includes a hydraulic system to actuate various components of the vehicle. For example, the hydraulic system may to raise and lower an implement, such as a bucket, at the operator's command. As such, the hydraulic system generally includes one or more hydraulic actuators and a pump configured to supply hydraulic fluid to the actuator(s).

Additionally, the hydraulic system may include various valves and other flow control devices to control the flow of the hydraulic fluid from the pump to the actuator(s). In this respect, the valves and other flow control devices may cause pressure drops at certain locations within the hydraulic system. To compensate for these pressure drops, the pump is controlled such that the pump discharges the hydraulic fluid a pressure that is typically much higher than the pressure needed to operate the hydraulic actuator(s) based on the operator's commands. However, operating the pump in this manner increases the energy consumption of the work vehicle, thereby reducing its fuel economy.

Accordingly, an improved system and method for controlling hydraulic fluid flow within a work vehicle would be welcomed in the technology. In particular, an improved system and method for controlling hydraulic fluid flow within a work vehicle that reduces the energy consumption of the vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a system for controlling hydraulic fluid flow within a work vehicle. The system includes a hydraulic actuator and a pump configured to supply hydraulic fluid to the hydraulic actuator via a fluid supply conduit. Additionally, the system includes a flow control valve defining an adjustable orifice, with the flow control valve being fluidly coupled to the fluid supply conduit upstream of the hydraulic actuator such that the flow control valve is configured to control a flow rate of the hydraulic fluid to the hydraulic actuator. Furthermore, the system includes a computing system configured to receive an input associated with a selected flow rate of the hydraulic fluid being supplied to the hydraulic actuator. Moreover, the computing system is configured to control an operation of the flow control valve such that flow control valve is at a maximum flow position at which the adjustable orifice has a maximum cross-sectional area. In addition, the computing system is configured to control an operation of the pump such that the pump supplies the hydraulic fluid to the hydraulic actuator through the adjustable orifice at the selected flow rate.

In another aspect, the present subject matter is directed to a system for controlling hydraulic fluid flow within a work vehicle. The system includes a first hydraulic actuator, a second hydraulic actuator in parallel with the first hydraulic actuator, and a pump configured to supply hydraulic fluid to the first hydraulic actuator via a first fluid supply conduit and a second hydraulic actuator via a second fluid supply conduit. Additionally, the system includes a first flow control valve defining an adjustable orifice, with the first flow control valve being fluidly coupled to the first fluid supply conduit upstream of the first hydraulic actuator such that the first flow control valve is configured to control a flow rate of the hydraulic fluid to the first hydraulic actuator. Furthermore, the system includes a second flow control valve defining an adjustable orifice, with the second flow control valve being fluidly coupled to the second fluid supply conduit upstream of the second hydraulic actuator such that the second flow control valve is configured to control a flow rate of the hydraulic fluid to the second hydraulic actuator. Moreover, the system includes a computing system configured to receive a first input associated with a first selected flow rate of the hydraulic fluid being supplied to the first hydraulic actuator and receive a second input associated with a second selected flow rate of the hydraulic fluid being supplied to the second hydraulic actuator. In addition, the computing system is configured to control an operation of one of the first or second flow control valve associated with the greater of the first or second selected flow rates such that the one of the first or second flow control valves is at a maximum flow position at which the adjustable orifice has a maximum cross-sectional area. Furthermore, the computing system is configured to control an operation of another of the first or second flow control valves based on the first and second selected flow rates. Moreover, the computing system is configured to control an operation of the pump such that the pump supplies the hydraulic fluid to the first hydraulic actuator through the adjustable orifice of the first flow control valve at the first selected flow rate and the second hydraulic actuator through the adjustable orifice of the second flow control valve at the second selected flow rate.

In a further aspect, the present subject matter is directed to a method for controlling hydraulic fluid flow within a work vehicle. The work vehicle, in turn, includes a hydraulic actuator, a pump configured to supply hydraulic fluid to the hydraulic actuator, and a flow control valve configured to control a flow rate of the hydraulic fluid to the hydraulic actuator. The method includes receiving, with a computing system, an input associated with a selected flow rate of the hydraulic fluid being supplied to the hydraulic actuator. Additionally, the method includes controlling, with the computing system, an operation of the flow control valve such that flow control valve is at a maximum flow position at which an adjustable orifice of the flow control valve has a maximum cross-sectional area. Furthermore, the method includes controlling, with the computing system, an operation of the pump such that the pump supplies the hydraulic fluid to the hydraulic actuator through the adjustable orifice at the selected flow rate.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
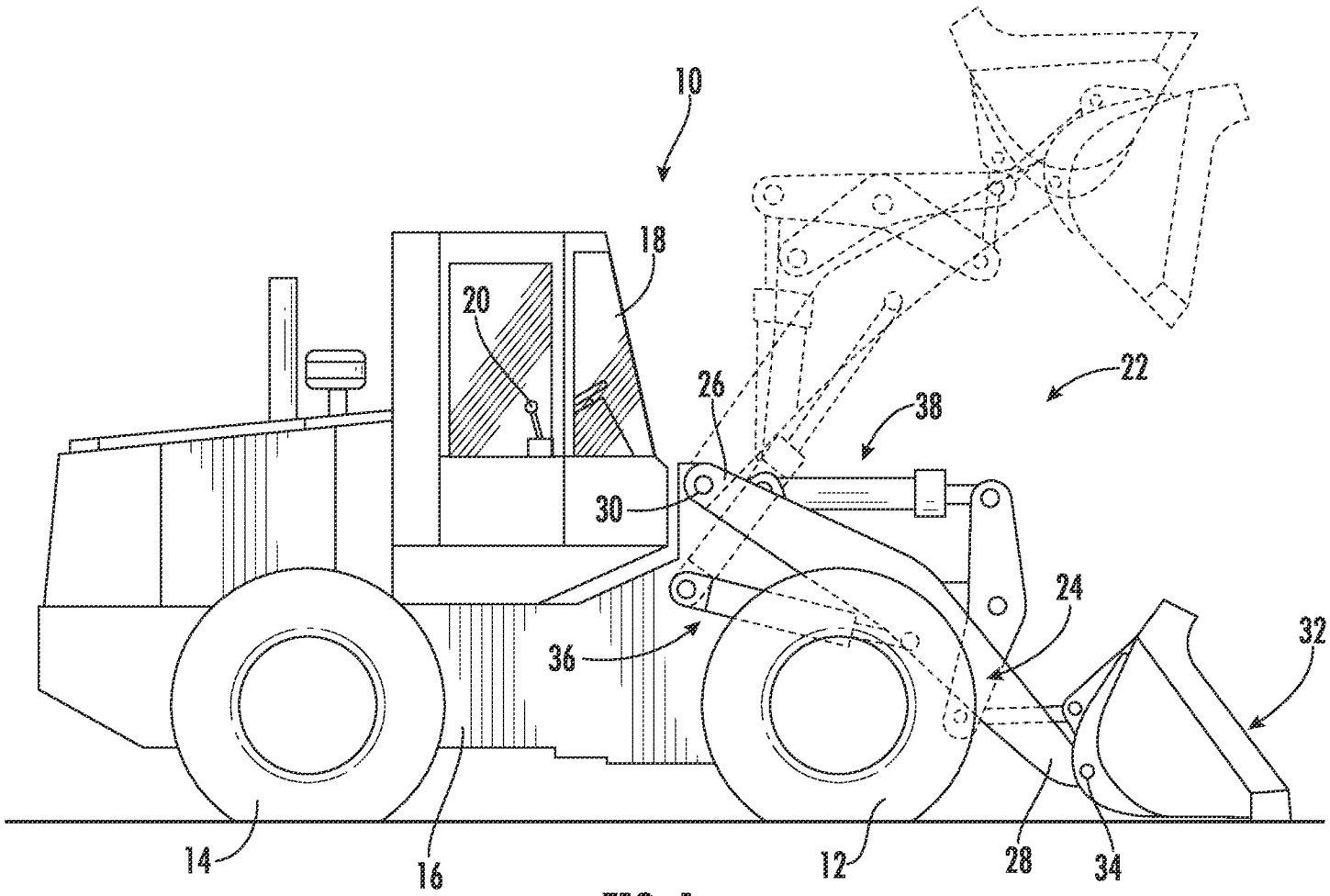
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a system for controlling hydraulic fluid flow within a work vehicle. As will be described below, the system may include a hydraulic actuator (e.g., a hydraulic cylinder) and a pump configured to supply hydraulic fluid to the hydraulic actuator via a fluid supply conduit. Additionally, the system may include a flow control valve fluidly coupled to the fluid supply conduit upstream of the hydraulic actuator such that the flow control valve is configured to control the flow rate of the hydraulic fluid to the hydraulic actuator.

In accordance with aspects of the present subject matter, a computing system may be configured to control the operation of the disclosed system in a manner that reduces the energy consumption of the work vehicle. Specifically, in several embodiments, the computing system may be configured to receive an input associated with a selected flow rate of the hydraulic fluid being supplied to the hydraulic actuator (e.g., from the operator of the vehicle). Upon receipt of the input, the computing system may be configured to control the operation of the flow control valve such that flow control valve is at a maximum flow position. When the flow control valve is at its maximum flow position, an adjustable orifice defined by the valve has its maximum cross-sectional area. Thereafter, the computing system may be configured to control the operation of the pump such that the pump supplies the hydraulic fluid to the hydraulic actuator through the adjustable orifice at the selected flow rate.

The disclosed system may provide one or more technical advantages. More specifically, opening the flow control valve to its maximum flow position upon receipt of an input associated with a selected flow rate reduces the pressure necessary to achieve the selected flow rate. That is, less pressure is required to achieve the selected flow rate when the flow control valve is at its maximum flow position than when the flow control valve is at position in which the cross-sectional area of the adjustable orifice is less than the maximum. Thus, by opening the flow control valve to its maximum flow position, the pump may be controlled such that the pump discharged fluid at a lower pressure, thereby reducing the energy consumption and increasing the fuel economy of the work vehicle.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other work vehicle including movable loader arms (e.g., any other type of front loader, such as skid steer loaders, backhoe loaders, compact track loaders, and/or the like).

As shown in FIG. 1, the work vehicle 10 includes a pair of front wheels 12, a pair or rear wheels 14, and a chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10. For instance, as shown in FIG. 1, the work vehicle 10 includes one or more joysticks or control levers 20 for controlling the operation of one or more components of a lift assembly 22 of the work vehicle 10.

As shown in FIG. 1, the lift assembly 22 includes a pair of loader arms 24 (one of which is shown) extending lengthwise between a first end 26 and a second end 28. In this respect, the first ends 26 of the loader arms 24 may be pivotably coupled to the chassis 16 at pivot joints 30. Similarly, the second ends 28 of the loader arms 24 may be pivotably coupled to a suitable implement 32 of the work vehicle 10 (e.g., a bucket, fork, blade, and/or the like) at pivot joints 34. In addition, the lift assembly 22 also includes a plurality of hydraulic actuators for controlling the movement of the loader arms 24 and the implement 30. For instance, the lift assembly 22 may include a pair of hydraulic lift cylinders 36 (one of which is shown) coupled between the chassis 16 and the loader arms 24 for raising and lowering the loader arms 24 relative to the ground. Moreover, the lift assembly 22 may include a pair of hydraulic tilt cylinders 38 (one of which is shown) for tilting or pivoting the implement 32 relative to the loader arms 24.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, the work vehicle 10 was described above as including a pair of lift cylinders 36 and a pair of tilt cylinders 38. However, in other embodiments, the work vehicle 10 may, instead, include any number of lift cylinders 36 and/or tilt cylinders 38, such as by only including a single lift cylinder 36 for controlling the movement of the loader arms 24 and/or a single tilt cylinder 38 for controlling the movement of the implement 32. Additionally, in some embodiments, the work vehicle 10 may include other hydraulic actuators to actuate or otherwise operate other components of the vehicle 10.

Figure 2:
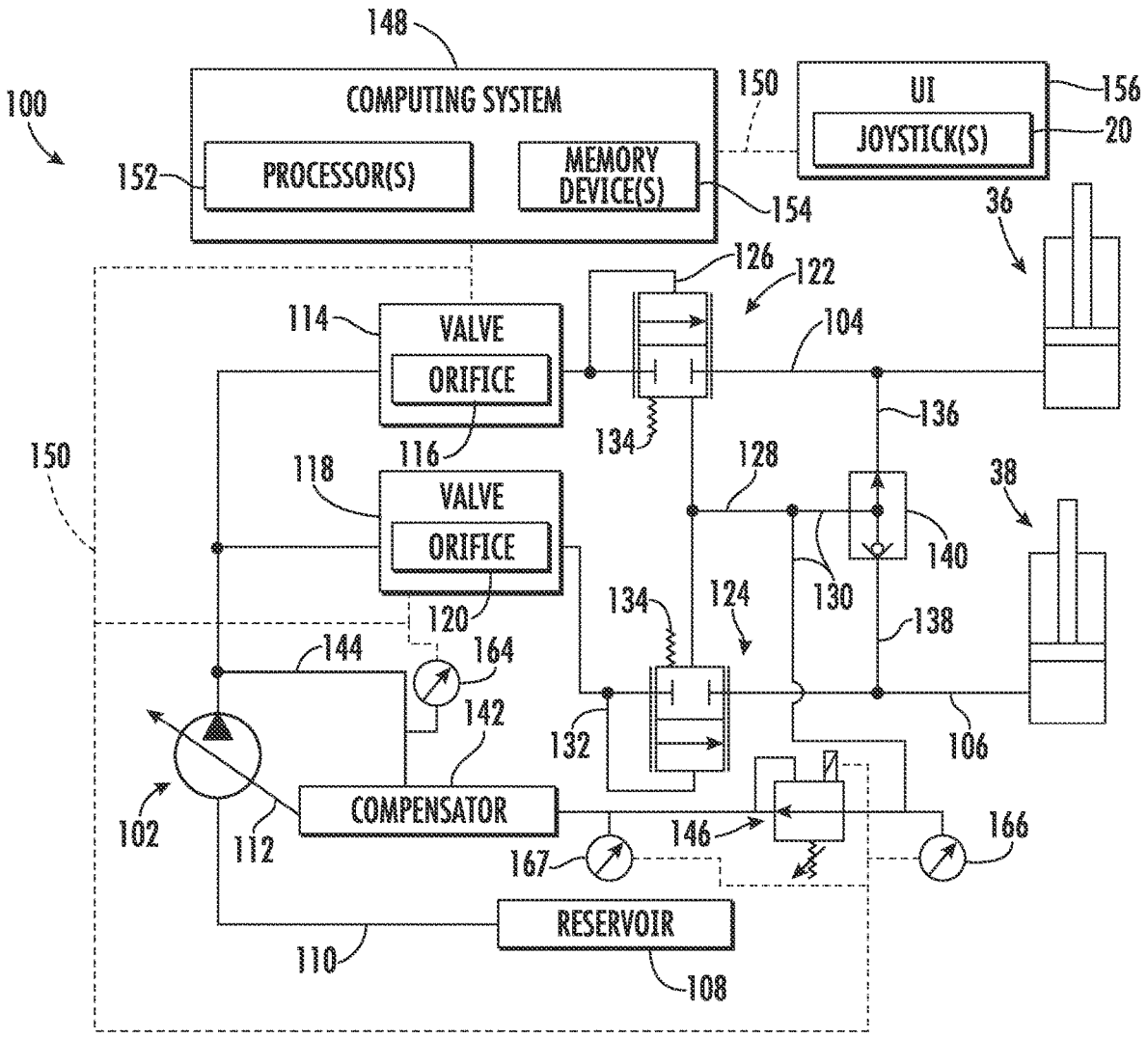
FIG. 2 illustrates a schematic view of one embodiment of a system for controlling hydraulic fluid flow within a work vehicle in accordance with aspects of the present subject matter.

Referring now to FIG. 2, a schematic view of one embodiment of a system 100 for controlling hydraulic fluid flow within a work vehicle is illustrated in accordance with aspects of the present subject matter. In general, the system 100 will be described herein with reference to the work vehicle 10 described above with reference to FIG. 1. However, it should be appreciated by those of ordinary skill in the art that the disclosed system 100 may generally be utilized with work vehicles having any other suitable vehicle configuration. For purposes of illustration, hydraulic connections between components of the system 100 are shown in solid lines while electrical connection between components of the system 100 are shown in dashed lines.

In several embodiments, as shown in FIG. 2, the system 100 may include one or more hydraulic actuators of the work vehicle 10. In this respect, as will be described below, the system 100 may be configured to regulate or otherwise control the hydraulic fluid flow within the work vehicle 10 such that the hydraulic fluid is supplied to the actuator(s) of the vehicle 10 in a manner that reduces the energy consumption of the vehicle 10. For example, in the illustrated embodiment, the system 100 includes the lift cylinders 36 and the tilt cylinders 38 of the work vehicle 10. In such an embodiment, the lift cylinder 26 and the tilt cylinder 38 may be in parallel with each other. However, in alternative embodiments, the system 100 may include any other suitable hydraulic actuators of the work vehicle 10 in addition to or lieu of the lift and tilt cylinders 36, 28, such as hydraulic actuators associated with other implements (e.g., a backhoe assembly), stabilizer legs, and/or the like.

As shown in FIG. 2, the system 100 may include a pump 102 configured to supply hydraulic fluid to the hydraulic actuator(s) of the vehicle 10. Specifically, in several embodiments, the pump 102 may be configured to supply hydraulic fluid to the lift cylinders 36 of the vehicle 10 via a first fluid supply conduit 104 and the tilt cylinders 38 of the vehicle 10 via a second fluid supply conduit 106. However, in alternative embodiments, the pump 102 may be configured to supply hydraulic fluid to any other suitable hydraulic actuators of the vehicle 10. Additionally, the pump 102 may be in fluid communication with a fluid tank or reservoir 108 via a pump conduit 110 to allow hydraulic fluid stored within the reservoir 108 to be pressurized and supplied to the lift and tilt cylinders 36, 38.

In several embodiments, the pump 102 may be a variable displacement pump configured to discharge hydraulic fluid across a given pressure range. Specifically, the pump 102 may supply pressurized hydraulic fluid within a range bounded by a minimum pressure and a maximum pressure capability of the variable displacement pump. In this respect, a swash plash plate 112 may be configured to be controlled (e.g., mechanically via a load sensing conduit 130 or electronically via a suitable computing system 148) to adjust the position of the swash plate 112 of the pump 102, as necessary, based on the load applied to the hydraulic system of the vehicle 10. However, in other embodiments, the pump 102 may correspond to any other suitable pressurized fluid source. Moreover, the operation of the pump 102 may be controlled in any other suitable manner.

Furthermore, the system 100 may include one or more flow control valves. In general, the flow control valve(s) may be fluidly coupled to a fluid supply conduit(s) upstream of the corresponding hydraulic actuator such that the flow control valve(s) is configured to control the flow rate of the hydraulic fluid to the actuator(s). Specifically, in several embodiments, the system 100 may include a first flow control valve 114 fluidly coupled to the first fluid supply conduit 104 upstream of the lift cylinders 36. As shown, the first flow control valve 114 may define an adjustable orifice 116. In this respect, by adjusting the cross-sectional area of the orifice 116, the first flow control valve 114 is able to control the flow rate of the hydraulic fluid to the lift cylinders 36. Moreover, in such embodiments, the system 100 may include a second flow control valve 118 fluidly coupled to the second fluid supply conduit 106 upstream of the tilt cylinders 38. As shown, the second flow control valve 118 may define an adjustable orifice 120. In this respect, by adjusting the cross-sectional area of the orifice 120, the second flow control valve 118 can control the flow rate of the hydraulic fluid to the tilt cylinders 38.

The first and second flow control valves 114, 118 may be configured as any suitable valves defining adjustable orifices. For example, in one embodiment, first and second flow control valves 114, 118 may be proportional directional valves. Such valves 114, 118 may include actuators (e.g., solenoid actuators) configured to adjust the cross-sectional areas of the orifices 116, 120 in response to receiving control signals (e.g., electric current) from the computing system 148. As such, the actuators may be configured to adjust the cross-sectional area of the orifices 116, 120 between a minimum flow position and a maximum flow position. When at the minimum flow position, the orifices 116, 120 may have their smallest cross-sectional areas (or, in some instances, be closed). Conversely, when at the maximum flow position, the orifices 116, 120 may have their largest cross-sectional areas. As will be described below, as the cross-sectional areas of the orifices 116, 120 increase, the pressure of hydraulic fluid need to provide a selected flow rate to the lift and tilt cylinders 36, 28 may decrease.

Additionally, in several embodiments, the system 100 may include one or more compensator valves. Specifically, in several embodiments, the system 100 may include a first compensator valve 122 fluidly coupled to the first fluid supply conduit 104 downstream of the first flow control valve 114. Moreover, in such embodiments, the system 100 may include a second compensator valve 124 fluidly coupled to the second fluid supply conduit 106 downstream of the second flow control valve 118. Thus, in such embodiments, the system 100 is a post-compensated system.

In operation, the first and second compensator valves 122, 124 may regulate the flow of the hydraulic fluid through the first and second fluid supply conduits 104, 106 such that the pressure of the hydraulic fluid within such conduits 104, 106 upstream of the compensator valves 104, 106 is the same. More specifically, the first compensator valve 122 may receive a pilot flow 126 of hydraulic fluid from the first fluid supply conduit 104 upstream of the valve 122 and a pilot flow 128 of hydraulic fluid from the load sense conduit 130. As will be described below, the load sense conduit 130 may receive hydraulic fluid bled from the first or second fluid supply conduit 104, 106 having the greater fluid pressure therein at a location downstream of the compensator valves 122, 124. Similarly, the second compensator valve 124 may receive a pilot flow 132 of hydraulic fluid from the second fluid supply conduit 106 upstream of the valve 124 and the pilot flow 128. Additionally, the first and second compensator valves 122, 124 may have biasing elements, such as spring 134, that set a compensator valve margin. In this respect, the first and second compensator valves 122, 124 may maintain a pressure within the first and second fluid supply conduits 104, 106 upstream of such valves 122, 124 that is equal to the sum of the compensator margin and the greater of the pressures within the first and second fluid supply conduits 104, 106 downstream of such valves 122, 124.

As indicated above, the load sense conduit 130 may receive hydraulic fluid bled from the first and second fluid supply conduits 104, 106 having the greater pressure therein. More specifically, the system 100 may include a first bleed conduit 136 fluidly coupled to the first fluid supply conduit 104 downstream of the first compensator valve 122. Furthermore, the system 100 may include a second bleed conduit 138 fluidly coupled to the second fluid supply conduit 106 downstream of the second compensator valve 124. Thus, the first bleed conduit 136 may receive hydraulic fluid bled from the first fluid supply conduit 104 and the second bleed conduit 138 may receive hydraulic fluid bled from the second fluid supply conduit 106. Additionally, the system 100 may include a shuttle valve 140 fluidly coupled to the first and second bleed conduits 136, 138 and the load sense conduit 130. The shuttle valve 140 may, in turn, be configured to supply hydraulic fluid from the first or second bleed conduit 136, 138 having the greater pressure therein to the load sense conduit 130. In this respect, the hydraulic fluid supplied to the load sense conduit 130 may have the same pressure as the fluid supply conduit 104, 106 having the greater of the pressures therein.

The hydraulic fluid within the load sense conduit 130 may be indicative of the load on the hydraulic system of the vehicle 10 and, thus, may be used to control the operation of the pump 102. More specifically, the load sense conduit 130 may supply the hydraulic fluid therein to a pump compensator 142. The pump compensator 142 may also receive a hydraulic fluid bled from the first and/or second fluid supply conduits 104, 106 upstream of the flow control valves 114, 118 via a bleed conduit 144. Additionally, the pump compensator 142 may have an associated a pump margin. In this respect, the pump compensator 142 may control the operation of the pump 102 such that the pump 102 discharges hydraulic fluid at a pressure that is equal to the sum of the pump margin and the pressure of the hydraulic fluid within the load sense conduit 130.

In this illustrated embodiment, the pump compensator 142 corresponds to a mechanical device. For instance, the pump compensator 142 may correspond to a passive hydraulic cylinder coupled to the swash plate 112 of the pump 102. In such an embodiment, hydraulic fluid from the load sense conduit 130 is supplied to one chamber of the cylinder and hydraulic fluid from the bleed conduit 144 is supplied to the other chamber of the cylinder. Moreover, the pump compensator 142 may include a biasing element, such as a spring, in association within the cylinder to set the pump margin. In this respect, when the sum of the pressure within the load sense conduit 130 and the pump margin exceeds the pressure within the bleed conduit 144, the pump compensator 142 may move the swash plate 112 to increase the pressure of the hydraulic fluid discharged by the pump 102. Conversely, when the sum of the pressure within the load sense conduit 130 and the pump margin falls below the pressure within the bleed conduit 144, the pump compensator 142 may move the swashplate 112 to decrease the pressure of the hydraulic fluid discharged by the pump 102. However, as will be described below, in other embodiments, the pump compensator 142 may be an electronically controlled actuator coupled to the swash plate 112.

Additionally, the system 100 may include a pressure-reducing valve 146 fluidly coupled to the load sense conduit 130. In general, the pressure-reducing valve 146 may be configured to reduce the pressure of the hydraulic fluid within the load sense conduit 130. Specifically, in several embodiments, the pressure-reducing valve 146 may be fluidly coupled to the load sense conduit 130 between the shuttle valve 140 and the pump compensator 142. In this respect, the pressure-reducing valve 146 may be configured to reduce the pressure of the hydraulic fluid supplied to the pump compensator 142 by the load sense conduit 130 to a pressure that is less than the pressure of the hydraulic fluid supplied to the load sense conduit 130 by the shuttle valve 140. As will be described below, by reducing the pressure of the hydraulic fluid supplied to the pump compensator 142, the energy consumption of the vehicle 10 may be decreased.

In accordance with aspects of the present subject matter, the system 100 may include a computing system 148 communicatively coupled to one or more components of the work vehicle 10 and/or the system 100 to allow the operation of such components to be electronically or automatically controlled by the computing system 148. For instance, the computing system 148 may be communicatively coupled to the first flow control valve 114 via a communicative link 150. As such, the computing system 148 may be configured to control the operation of the valve 114 to regulate the flow of the hydraulic fluid to the lift cylinders 36 such that the lift cylinders 36 raise and lower the loader arms 28 relative to the field surface. Furthermore, the computing system 148 may be communicatively coupled to the second flow control valve 118 via the communicative link 150. In this respect, the computing system 148 may be configured to control the operation of the valve 118 to regulate the flow of the hydraulic fluid to the tilt cylinders 38 such that the tilt cylinders 38 adjust the tilt of the implement 32. Moreover, the computing system 148 may be communicatively coupled to the pressure-reducing valve 146 via the communicative link 150. Thus, the computing system 148 may be configured to control the operation of the pressure-reducing valve 146 to adjust the pressure of the hydraulic fluid supplied to the pump compensator 142 by the load sense conduit 130. As will be described below, such adjustment to the hydraulic fluid supplied to the pump compensator 142 may reduce the energy consumption of the vehicle 10.

In general, the computing system 148 may comprise one or more processor-based devices, such as a given controller or computing device or any suitable combination of controllers or computing devices. Thus, in several embodiments, the computing system 148 may include one or more processor(s) 152 and associated memory device(s) 154 configured to perform a variety of computer-implemented functions. As used herein, the term "processor" refers not only to integrated circuits referred to in the art as being included in a computer, but also refers to a controller, a microcontroller, a microcomputer, a programmable logic circuit (PLC), an application specific integrated circuit, and other programmable circuits. Additionally, the memory device(s) 154 of the computing system 148 may generally comprise memory element(s) including, but not limited to, a computer readable medium (e.g., random access memory RAM)), a computer readable non-volatile medium (e.g., a flash memory), a floppy disk, a compact disk-read only memory (CD-ROM), a magneto-optical disk (MOD), a digital versatile disk (DVD) and/or other suitable memory elements. Such memory device(s) 154 may generally be configured to store suitable computer-readable instructions that, when implemented by the processor(s) 152, configure the computing system 148 to perform various computer-implemented functions, such as one or more aspects of the methods and algorithms that will be described herein. In addition, the computing system 148 may also include various other suitable components, such as a communications circuit or module, one or more input/output channels, a data/control bus and/or the like.

The various functions of the computing system 148 may be performed by a single processor-based device or may be distributed across any number of processor-based devices, in which instance such devices may be considered to form part of the computing system 148. For instance, the functions of the computing system 148 may be distributed across multiple application-specific controllers or computing devices, such as an implement controller, a navigation controller, an engine controller, and/or the like.

Furthermore, in some embodiment, the system 100 may also include a user interface 156. More specifically, the user interface 156 may be configured to receive inputs (e.g., inputs associated with one or more selected flow rates of hydraulic fluid to the hydraulic actuators of the vehicle 10) from the operator. As such, the user interface 156 may include one or more input devices, such as touchscreens, keypads, touchpads, knobs, buttons, sliders, switches, mice, microphones, and/or the like, which are configured to receive user inputs from the operator. For example, in one embodiment, the user interface 156 may include the joystick (s) 20. The user interface 156 may, in turn, be communicatively coupled to the controller 146 via the communicative link 150 to permit the received inputs to be transmitted from the user interface 156 to the controller 146. In addition, some embodiments of the user interface 156 may include one or more feedback devices (not shown), such as display screens, speakers, warning lights, and/or the like, which are configured to provide feedback from the controller 146 to the operator. In one embodiment, the user interface 156 may be mounted or otherwise positioned within the cab 18 of the vehicle 10. However, in alternative embodiments, the user interface 156 may mounted at any other suitable location.

In several embodiments, the system 100 may include a plurality of pressure sensors configured to capture data indicative of the pressure of the hydraulic fluid at differing locations within the hydraulic system of the vehicle 10. Specifically, in one embodiment, the system 100 may include a first pressure sensor 164 fluidly coupled to the bleed conduit 144 and a second pressure sensor 166 fluidly coupled to the load sense conduit 130 upstream of the pressure-reducing valve 146. As such, the first pressure sensor 164 may be configured to capture data indicative of the pressure of the hydraulic fluid being discharged by the pump 102 and the second pressure sensor 166 may be configured to capture data indicative of the pressure of the hydraulic fluid within the load sense conduit 130. Moreover, the first and second pressure sensors 164, 166 may be communicatively coupled to the computing system 148 via the communicative link 150. Thus, the computing system 148 may be configured to receive the captured data from the first and second pressure sensors 164, 166.

In another embodiment, the system 100 may include the second pressure sensor 166 fluidly coupled to the load sense conduit 130 upstream of the pressure-reducing valve 146 and a third pressure sensor 167 fluidly coupled to the load sense conduit 130 downstream of the pressure-reducing valve 146. As such, the second pressure sensor 166 may be configured to capture data indicative of the pressure of the hydraulic fluid within the load sense conduit 130 upstream of the valve 146 and the third pressure sensor 167 may be configured to capture data indicative of the pressure of the hydraulic fluid within the load sense conduit 130 downstream of the valve 146. Moreover, the second and third pressure sensors 166, 167 may be communicatively coupled to the computing system 148 via the communicative link 150. Thus, the computing system 148 may be configured to receive the captured data from the second and third pressure sensors 166, 167. As will be described below, the computing system 148 may be configured to control the operation of the pump compensator 142 based on the data captured by the pressure sensors 164, 166 or the pressure sensors 166, 167.

Figure 3:
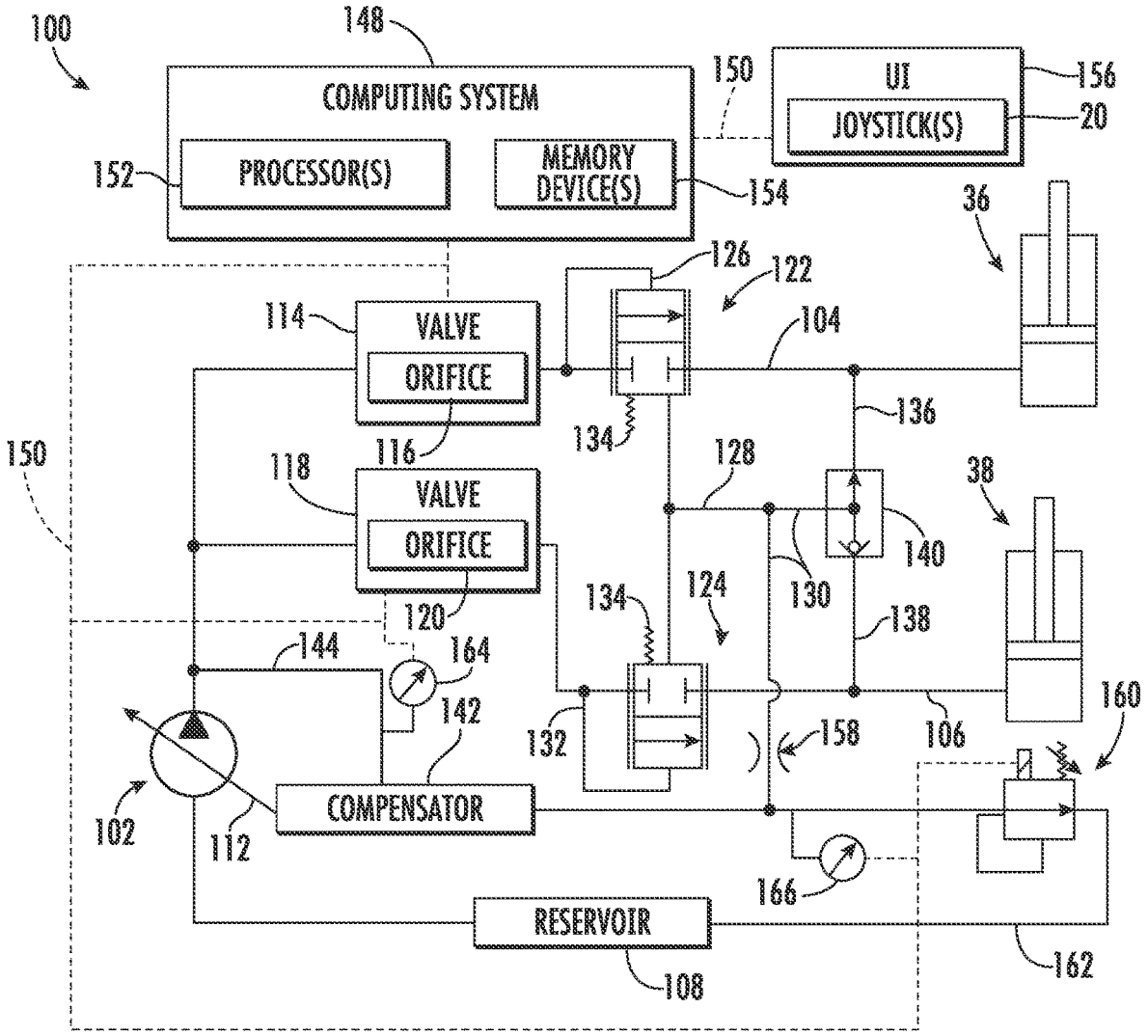
FIG. 3 illustrates a schematic view of another embodiment of a system for controlling hydraulic fluid flow within a work vehicle in accordance with aspects of the present subject matter.

Referring now to FIG. 3, a schematic view of another embodiment of the system 100 for controlling hydraulic fluid flow within a work vehicle is illustrated in accordance with aspects of the present subject matter. In general, the embodiment of the system 100 depicted in FIG. 3 is configured similarly to the embodiment of the system 100 depicted in FIG. 2. For example, like the system 100 illustrated in FIG. 2, the system 100 shown in FIG. 3 includes various components of the hydraulic system of the work vehicle 10, such as the lift cylinders 36; the tilt cylinders 38; the pump 102; the fluid supply conduits 104, 106; the flow control valves 114, 116; the load sense conduit 130; and the pump compensator 142 as well as the controller 148, the user interface 154, and the first and second pressure sensors 164, 166. However, unlike the system 100 of FIG. 2, the system 100 depicted in FIG. 3 does not include the pressure-reducing valve 146 fluidly coupled to the load sense conduit 130. Instead, as shown in FIG. 3, the system 100 includes an orifice 158 and a pressure relief valve 160 fluidly coupled to the load sense conduit 130.

In several embodiments, the orifice 158 and a pressure relief valve 160 are configured to control the flow rate of the hydraulic fluid through the load sense conduit 130. More specifically, the orifice 158 may be fluidly coupled to the load sense conduit 130 between the shuttle valve 140 and the pump compensator 142. Furthermore, the pressure relief valve 160 may be fluidly coupled to the load sense conduit 130 between the orifice 158 and the pump compensator 142. Moreover, the pressure relief valve 160 may be fluidly coupled to the reservoir 108 via a relief conduit 162. In this respect, the pressure relief valve 160 may be configured to selectively direct a portion of the hydraulic fluid therein to the reservoir 108 via the relief conduit 162, thereby reducing the pressure of the hydraulic fluid within the load sense conduit 130. Additionally, the pressure relief valve 160 may be communicatively coupled to the computing system 148 via the communicative link 150. Thus, the computing system 148 may be configured to control the operation of the pressure relief valve 160 to adjust the pressure of the hydraulic fluid supplied to the pump compensator 142 by the load sense conduit 130. Thus, the pressure relief valve 160 may allow the load sense conduit 130 to supply hydraulic fluid to the pump compensator 142 at a pressure that is less than the pressure of the hydraulic fluid supplied to the load sense conduit 130 by the shuttle valve 140. As will be described below, by reducing the pressure of the hydraulic fluid supplied to the pump compensator 142, the energy consumption of the vehicle 10 may be decreased.

Figure 4:
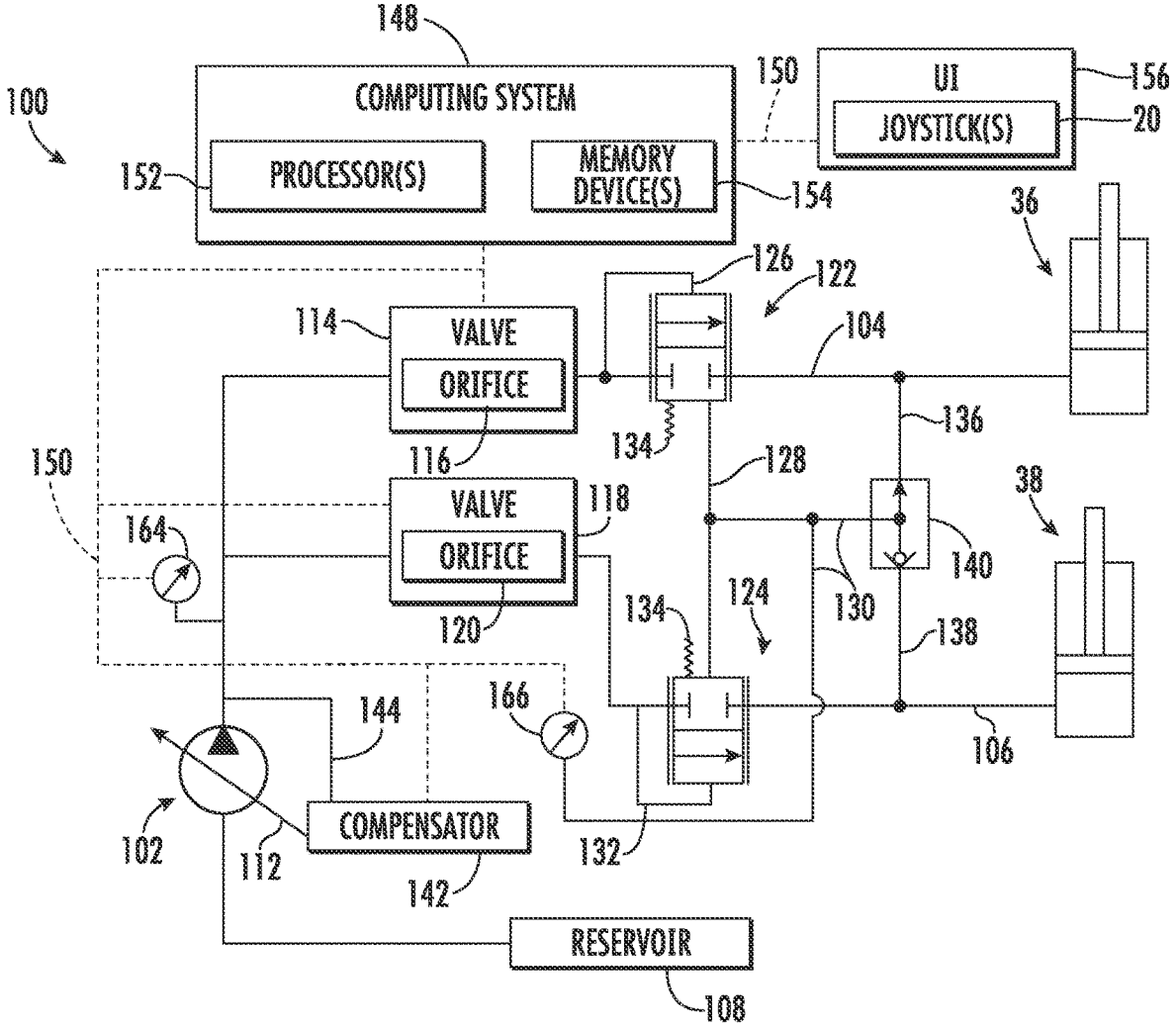
FIG. 4 illustrates a schematic view of a further embodiment of a system for controlling hydraulic fluid flow within a work vehicle in accordance with aspects of the present subject matter.

Referring now to FIG. 4, a schematic view of a further embodiment of the system 100 for controlling hydraulic fluid flow within a work vehicle is illustrated in accordance with aspects of the present subject matter. In general, the embodiment of the system 100 depicted in FIG. 4 is configured similarly to the embodiments of the system 100 depicted in FIGS. 2 and 3. For example, like the system 100 illustrated in FIGS. 2 and 3, the system 100 shown in FIG. 4 includes various components of the hydraulic system of the work vehicle 10, such as the lift cylinders 36; the tilt cylinders 38; the pump 102; the fluid supply conduits 104, 106; the flow control valves 114, 116; the load sense conduit 130; and the pump compensator 142 as well as the controller 146, the user interface 154, and the pressure sensors 164, 166. However, unlike the system 100 of FIGS. 2 and 3, the system 100 depicted in FIG. 4 does not include the pressure-reducing valve 146 or the pressure relief valve 160 to adjust the operation of the pump 102. Instead, in the embodiment of FIG. 4, the operation of the pump 102 is electronically controlled by the computing system 148. In such an embodiment, the pump compensator 142 does not receive hydraulic fluid from the load sense conduit 130. Instead, the pump compensator 142 only receives hydraulic fluid bled from upstream of the flow control valves 114, 118 via the bleed conduit 144. In this respect, the pump compensator 142 includes an electronically controlled actuator (e.g., a solenoid, electric linear actuator, a stepper motor, and/or the like) that, along with the biasing element, oppose the force exerted by the hydraulic fluid received from the bleed conduit 144. As such, the computing system 148 may control the actuator to adjust the operation of the pump 102 based on the data received from the pressure sensors 164, 166.

Figure 5:
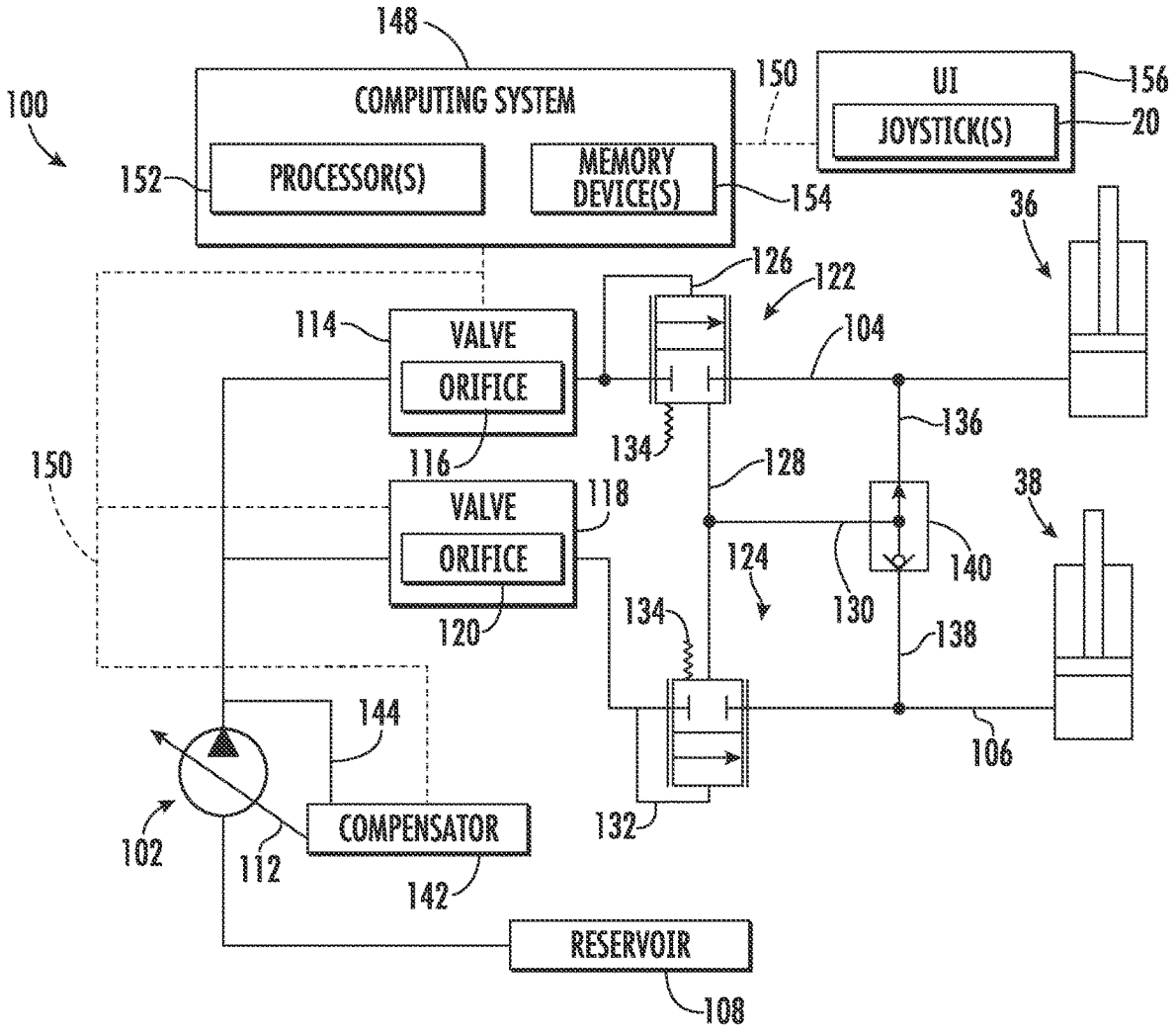
FIG. 5 illustrates a schematic view of yet another embodiment of a system for controlling hydraulic fluid flow within a work vehicle in accordance with aspects of the present subject matter.

Referring now to FIG. 5, a schematic view of a further embodiment of the system 100 for controlling hydraulic fluid flow within a work vehicle is illustrated in accordance with aspects of the present subject matter. In general, the embodiment of the system 100 depicted in FIG. 5 is configured similarly to the embodiment of the system 100 depicted in FIG. 4. For example, like the system 100 illustrated in FIG. 4, the system 100 shown in FIG. 5 includes various components of the hydraulic system of the work vehicle 10, such as the lift cylinders 36; the tilt cylinders 38; the pump 102; the fluid supply conduits 104, 106; the flow control valves 114, 116; and the electronically controlled pump compensator 142 as well as the controller 146 and the user interface 154. However, unlike the system 100 of FIG. 4, the system 100 depicted in FIG. 5 does not include the pressure sensors 164, 166. Instead, the system 100 of FIG. 5 is controlled in an open-loop manner. Specifically, in such an embodiment, the computing system 148 is configured to control the flow rate of the hydraulic fluid discharged from the pump 102 based on the desired flow rate(s) of the hydraulic fluid to the lift and tilt cylinders 36, 38.

Figure 6:
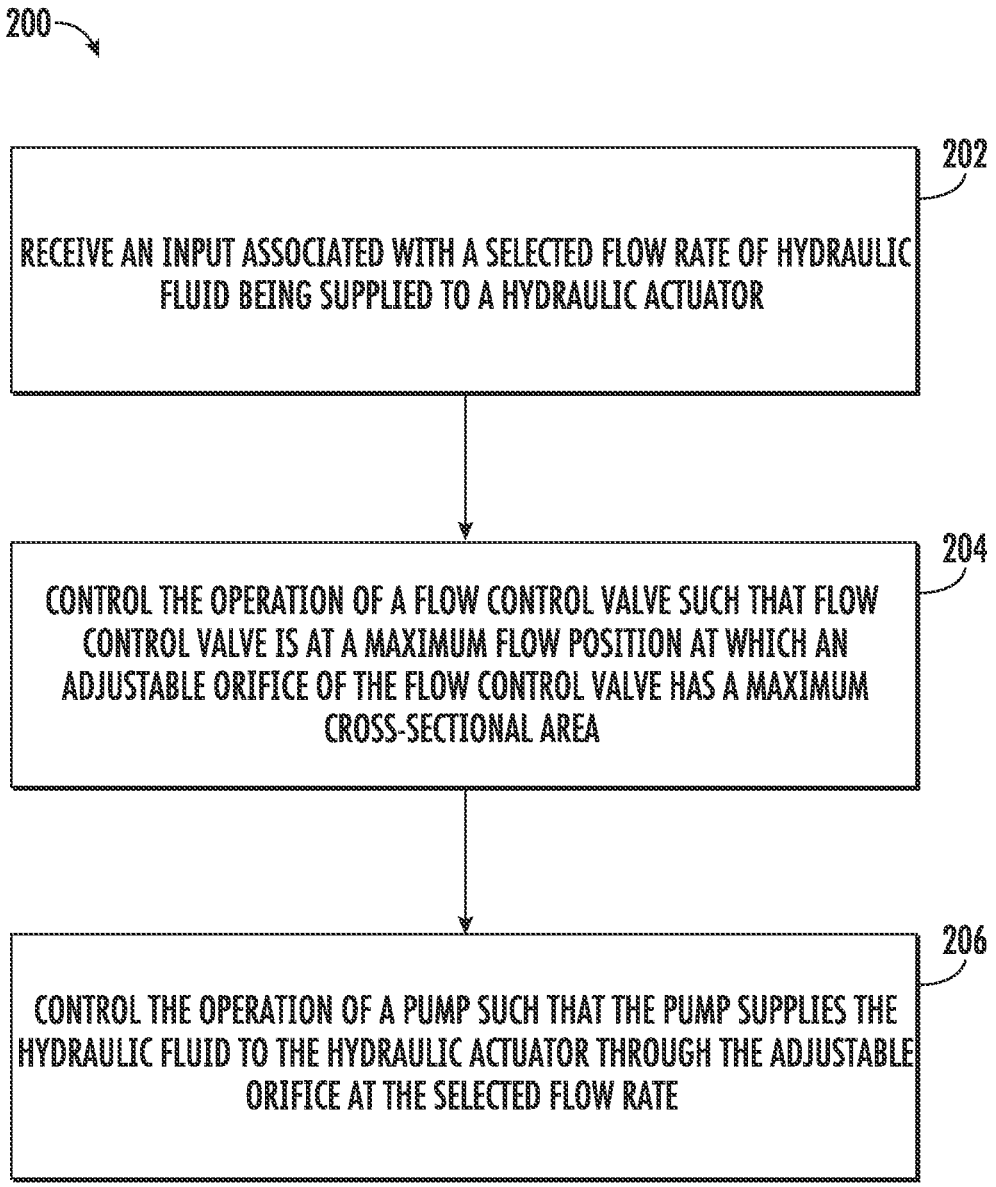
FIG. 6 illustrates a flow diagram of another embodiment of a method for controlling hydraulic fluid flow within a work vehicle in accordance with aspects of the present subject matter.

Referring now to FIG. 6, a flow diagram of one embodiment of a method 200 for controlling hydraulic fluid flow within a work vehicle is illustrated in accordance with aspects of the present subject matter. In general, the method 200 will be described herein with reference to the work vehicle 10 and the system 100 described above with reference to FIGS. 1-5. However, it should be appreciated by those of ordinary skill in the art that the disclosed method 200 may generally be implemented with any work vehicle having any suitable vehicle configuration and/or within any system having any suitable system configuration. In addition, although FIG. 6 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 6, at (202), the method 200 may include receiving, with a computing system, an input associated with a selected flow rate of hydraulic fluid being supplied to a hydraulic actuator. More specifically, the operator of the work vehicle 10 may provide an input to the user interface 156 (e.g., via the control lever(s) 20) associated with a selected flow rate of hydraulic fluid being supplied to the lift cylinders 36 or the tilt cylinder 38. The input may then by transmitted from the user interface 156 to the computing system 148 via the communicative link 150.

Additionally, at (204), the method 200 may include controlling, with the computing system, the operation of a flow control valve such that the flow control valve is at a maximum flow position at which an adjustable orifice of the flow control valve has a maximum cross-sectional area. In several embodiments, upon receipt of the input associated with the selected flow rate, the computing system 148 may be configured to control the operation of the corresponding flow control valve 114, 118. Specifically, the computing system 148 may transmit control signals to the corresponding flow control valve 114, 118 via the communicative link 150. Such control signals may, in turn, instruct the valve 114, 118 to open its adjustable orifice 116, 120 to the maximum flow position at which the orifice 116, 120 has the maximum cross-sectional area. The adjustable orifice 116, 120 may be opened to its maximum flow position regardless of the selected flow rate. For example, in one instance, the selected flow rate may be associated with a position at which the cross- sectional area of the orifice 116, 120 is sixty percent of the maximum cross-sectional area. In such an instance, the orifice 116, 120 may be opened to its maximum flow position.

Moreover, as shown in FIG. 6, at (206), the method 200 may include controlling, with the computing system, the operation of a pump such that the pump supplies the hydraulic fluid to the hydraulic actuator through the adjustable orifice at the selected flow rate. In several embodiments, after the flow control valve 114, 118 is at its maximum flow position, the computing system 148 may be configured to control the operation of the pump 102 such that the pump 102 supplies hydraulic fluid to the lift or tilt cylinders 36, 38 at the selected flow rate. Specifically, in some embodiments (e.g., the embodiments shown in FIGS. 2-4), the computing system 148 may be configured to control the operation of the pump 102 such that the pressure of the hydraulic fluid discharged by the pump 102 allows the hydraulic fluid to be supplied though the orifice 116, 120 (when the orifice 116, 120 at its maximum flow position) to the lift or tilt cylinders 36, 38 at the selected flow rate.

In several embodiments, at (206), the computing system 148 may be configured to initiate an adjustment to the pressure of the hydraulic fluid within the load sense conduit 130 to control the operation of the pump 102. For example, as described above, in one embodiment, the pressure-reducing valve 146 may be fluidly coupled to the load sense conduit 130. In such an embodiment, the computing system 148 may be configured to may transmit control signals to the pressure-reducing valve 146 via the communicative link 150. Such control signals may, in turn, instruct the pressure-reducing valve 146 to reduce the pressure of the hydraulic fluid being supplied to the pump compensator 142 to a pressure that causes the pump 102 to operate such that the pump 102 discharges hydraulic fluid at a pressure that provides hydraulic fluid to the lift or tilt cylinders 36, 38 at the selected flow rate. Moreover, as described above, in another embodiment, the pressure relief valve 160 is fluidly coupled to the load sense conduit 130. In such an embodiment, the computing system 148 may be configured to may transmit control signals to the pressure relief valve 160 via the communicative link 150. Such control signals may, in turn, instruct the pressure relief valve 160 to reduce the pressure of the hydraulic fluid being supplied to the pump compensator 142 to a pressure that causes the pump 102 to operate such that the pump 102 discharges hydraulic fluid at a pressure that provides hydraulic fluid to the lift or tilt cylinders 36, 38 at the selected flow rate.

In a further embodiment, at (206), the computing system 148 may be configured to automatically control the operation of the pump 102. More specifically, in such an embodiment, the computing system 148 may be configured to determine the pressure of the hydraulic fluid being discharged from the pump 102 based on the data captured by the first pressure sensor 164. Furthermore, the computing system 148 may be configured to determine the pressure of the hydraulic fluid within the load sense conduit 130 based on the data captured by the second pressure sensor 166. In this respect, the computing system 148 may be configured to control the pump compensator 142 to adjust the operation of the pump 102 based on the determined pressure of the hydraulic fluid being discharged from the pump 102 and the determined pressure of the hydraulic fluid within the load sense conduit 130 such that hydraulic fluid is provided to the lift or tilt cylinders 36, 28 at the selected flow rate. In other embodiments (e.g., the embodiment shown in FIG. 5), the computing system 148 may be configured to control the operation of the pump 102 such that the flow rate of the hydraulic fluid discharged by the pump 102 allows the hydraulic fluid to be supplied though the orifice 116, 120 (when the orifice 116, 120 at its maximum flow position) to the lift or tilt cylinders 36, 38 at the selected flow rate.

Controlling the operation of the flow control valve 114, 118 such that valve 114, 118 is at a maximum flow position upon receipt of the input associated with the selected flow rate may reduce the energy consumption of the work vehicle 10, thereby improving its fuel economy. More specifically, less pressure is generally required to meet the selected flow rate when the flow control valve 114, 118 is at its maximum flow position. In this respect, opening the valve 114, 118 to its maximum flow position when the selected flow rate is less than the maximum flow rate may allow the pressure of the hydraulic fluid discharged by the pump 102 to be reduced. Such a reduction in pump discharge pressure may, in turn, reduce the energy consumption of pump 102 and, thus, the work vehicle 10. Moreover, in embodiments in which the pump compensator 142 is mechanical, the pump margin may not be dynamically adjusted. As such, the pressure-reducing valve 146 or the pressure relief valve 160 may allow to the pressure of the hydraulic fluid within the load sense conduit 130 to be dynamically adjusted in a manner that allows the pump discharge pressure to be adjusted to meet the selected flow rate.

Figure 7:
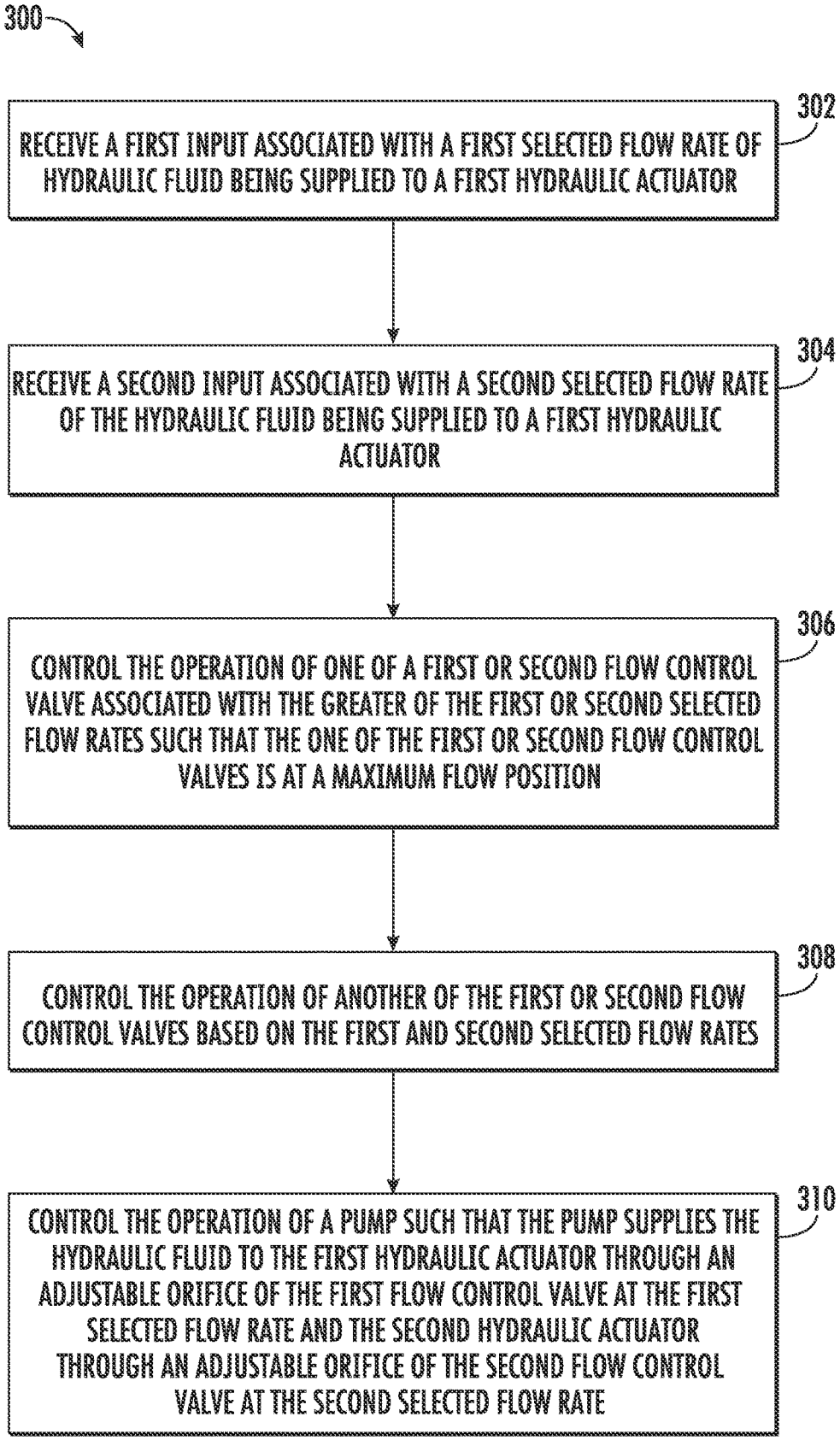
FIG. 7 illustrates a flow diagram of another embodiment of a method for controlling hydraulic fluid flow within a work vehicle in accordance with aspects of the present subject matter.

Referring now to FIG. 7, a flow diagram of another embodiment of a method 300 for controlling hydraulic fluid flow within a work vehicle is illustrated in accordance with aspects of the present subject matter. In general, the method 300 will be described herein with reference to the work vehicle 10 and the system 100 described above with reference to FIGS. 1-5. However, it should be appreciated by those of ordinary skill in the art that the disclosed method 300 may generally be implemented with any work vehicle having any suitable vehicle configuration and/or within any system having any suitable system configuration. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (302), the method 300 may include receiving, with a computing system, a first input associated with a first selected flow rate of the hydraulic fluid being supplied to a first hydraulic actuator. More specifically, the operator of the work vehicle 10 may provide a first input to the user interface 156 (e.g., via the control lever(s) 20) associated with a first selected flow rate of the hydraulic fluid being supplied to the lift cylinders 36 or the tilt cylinders 38. The first input may then by transmitted from the user interface 156 to the computing system 148 via the communicative link 150.

Additionally, at (304), the method 300 may include receiving, with a computing system, a second input associated with a second selected flow rate of the hydraulic fluid being supplied to a second hydraulic actuator. More specifically, the operator of the work vehicle 10 may provide a second input to the user interface 156 (e.g., via the control lever(s) 20) associated with a second selected flow rate of the hydraulic fluid being supplied to the other of the lift cylinders 36 or the tilt cylinders 38. The second input may then by transmitted from the user interface 156 to the computing system 148 via the communicative link 150. In some instances, the first and second selected flow rates may be different.

Moreover, as shown in FIG. 7, at (306), the method 300 may include controlling, with the computing system, the operation of one of a first or second flow control valve associated with the greater of the first or second selected flow rates such that the one of the first or second flow control valves is at a maximum flow position. As described above, the computing system 148 may receive input associated with first and second selected flow rates. In this respect, upon receipt of such inputs, the computing system 148 may be configured to determine which of the selected flow rates is greater. Thereafter, the computing system 148 control the operation of the flow control valve 114, 118 corresponding to the greater flow rate such that the orifice 116, 120 of the valve 114, 118 is at its maximum flow position. Specifically, the computing system 148 may transmit control signals to the flow control valve 114, 118 corresponding to the greater flow rate via the communicative link 150. Such control signals may, in turn, instruct the valve 114, 118 to open the its orifice 116, 120 to the maximum flow position at which the orifice 116, 120 of the valves 114, 118 has a maximum cross-sectional area. The orifice 116, 120 may be opened to its maximum flow position regardless of the selected flow rate.

Furthermore, at (308), the method 300 may include controlling, with the computing system, the operation of another of the first or second flow control valves based on the first and second selected flow rates. More specifically, the computing system 148 may be configured to control the other of the first or second flow control valves 114, 118 (i.e., the valve 114, 118 associated with the lower of the selected flow rates) based on the first and second selected flow rates. In several embodiments, the other of the valves 114, 118 may be controlled based on the following equation:

$$\frac{Q_1}{Q_2} = \frac{\Omega_1}{\Omega_2}$$

in which the $Q_1$ is the first selected flow rate, $Q_2$ is the second selected flow rate, $\Omega_1$is the cross-sectional area of the orifice 116, 120 associated with the first selected flow rate, and $\Omega_2$ is the cross-sectional area of the orifice 116, 120 associated with the second selected flow rate. Thus, adjustable orifice 116, 120 of the valves 114, 118 corresponding to the lower selected flow rate may be opened to a position between the minimum and maximum flow positions. As such, the computing system 148 may transmit control signals to the flow control valve 114, 118 corresponding to the lower selected flow rate via the communicative link 150. Such control signals may, in turn, instruct the valve 114, 118 to open the corresponding adjustable orifice 116, 120 to a flow position determined based on the first and second selected flow rates.

For example, in one instance, the operator may input a selected flow rate for the lift cylinders 36 associated with twenty percent of the maximum flow rate and a selected flow rate for the tilt cylinders 38 associated with sixty percent of the maximum flow rate. In such an instance, the computing system 148 may be configured to control the operation of the orifice 120 of the second flow control valve 118 (i.e., the valve associated with the greater selected flow rate) such that the orifice 120 is at its maximum flow position. Furthermore, in such an instance, the computing system 148 may be configured to control the operation of the orifice 116 of the first flow control valve 114 (i.e., the valve associated with the lower selected flow rate) such that the orifice 116 is at a position associated with thirty-three percent of its maximum cross-sectional area.

In addition, as shown in FIG. 7, at (310), the method 300 may include controlling, with the computing system, the operation of a pump such that the pump supplies the hydraulic fluid to the first hydraulic actuator through the adjustable orifice of the first flow control valve at the first selected flow rate and the second hydraulic actuator through the adjustable orifice of the second flow control valve at the second selected flow rate. In several embodiments, after adjusting the orifices 116, 120 of the flow control valves 114, 1118 as described above, the computing system 148 may be configured to control the operation of the pump 102 such that the pump 102 supplies hydraulic fluid to the lift or tilt cylinders 36, 38 at the selected flow rates. Specifically, the computing system 148 may be configured to control the operation of the pump 102 such that the pressure of the hydraulic fluid discharged by the pump 102 allows the hydraulic fluid to be supplied though the orifice 116 to the lift cylinders 36 at the first selected flow rate and through the orifice 120 to the tilt cylinders 38 at the second selected flow rate. For example, as described above, in some embodiments, the operation of the pump 102 may be controlled by adjusting the pressure of the hydraulic fluid within the load sense conduit 130 via the pressure-reducing valve 146 or the pressure relief valve 160. Moreover, as described above, in other embodiments, the computing system 148 may directly control the pump compensator 142 to adjust the operation of the pump 102 to adjust the pressure (FIGS. 2-4) or the flow rate (FIG. 5) of the hydraulic fluid discharged by the pump 102.

Controlling the operation of the flow control valves 114, 118 in accordance with method 300 may reduce the energy consumption of the work vehicle 10, thereby improving its fuel economy. More specifically, less pressure is generally required to meet the first and second selected flow rates when the orifices 116, 120 of the flow control valves 114, 118 have greater cross-sectional areas. In this respect, opening the valve 114, 118 associated with the greater selected flow rate to its maximum flow position and opening the valve 114, 118 associated with the lower selected flow rate to position based on the first and second selected flow ratesas described above may allow the pressure of the hydraulic fluid discharged by the pump 102 to be reduced. Such a reduction in pump discharge pressure may, in turn, the energy consumption of pump 102 and, thus, the work vehicle 10. Moreover, in embodiments in which the pump compensator 142 is mechanical, the pump margin may not be dynamically adjusted. As such, the pressure-reducing valve 146 or the pressure relief valve 160 may allow to the pressure of the hydraulic fluid within the load sense conduit 130 to be dynamically adjusted in a manner that allows the pump discharge pressure to be adjusted such that the selected flow rates are met.

It is to be understood that the steps of the methods 200, 300 are performed by the computing system 148 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the computing system 148 described herein, such as the methods 200, 300, is implemented in software code or instructions which are tangibly stored on a tangible computer readable medium. The computing system 148 loads the software code or instructions via a direct interface with the computer readable medium or via a wired and/or wireless network. Upon loading and executing such software code or instructions by the computing system 148, the computing system 148 may perform any of the functionality of the computing system 148 described herein, including any steps of the methods 200, 300 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A system for controlling hydraulic fluid flow within a work vehicle, the system comprising:

a hydraulic actuator;

a pump configured to supply hydraulic fluid to the hydraulic actuator via a fluid supply conduit;

a flow control valve defining an adjustable orifice, the flow control valve being fluidly coupled to the fluid supply conduit upstream of the hydraulic actuator such that the flow control valve is configured to control a flow rate of the hydraulic fluid to the hydraulic actuator;

a load sense conduit fluidly coupled to the fluid supply conduit downstream of the flow control valve, wherein the operation of the pump is controlled based on a pressure of the hydraulic fluid within the load sense conduit;

a pressure relief valve fluidly coupled to the load sense conduit, the pressure relief valve configured to selectively permit a portion of the hydraulic fluid within the load sense conduit to flow to a reservoir; and a computing system configured to:

receive an input associated with a selected flow rate of the hydraulic fluid being supplied to the hydraulic actuator;

control an operation of the flow control valve such that flow control valve is at a maximum flow position at which the adjustable orifice has a maximum cross-sectional area;

control an operation of the pump based on a pressure of the hydraulic fluid within the load sense conduit such that the pump supplies the hydraulic fluid to the hydraulic actuator through the adjustable orifice at the selected flow rate, wherein, when controlling the operation of the pump, the computing system is configured to initiate an adjustment of a pressure of the hydraulic fluid discharged into the fluid supply conduit such that the hydraulic fluid is supplied to the hydraulic actuator through the adjustable orifice at the selected flow rate; and control an operation of the pressure relief valve to adjust the pressure of the hydraulic fluid within the load sense conduit.

2. The system of claim 1, further comprising:

a compensator valve fluidly coupled to fluid supply conduit downstream of the flow control valve.

3. A system for controlling hydraulic fluid flow within a work vehicle, the system comprising:

a first hydraulic actuator;

a second hydraulic actuator in parallel with the first hydraulic actuator;

a pump configured to supply hydraulic fluid to the first hydraulic actuator via a first fluid supply conduit and the second hydraulic actuator via a second fluid supply conduit;

a first flow control valve defining an adjustable orifice, the first flow control valve being fluidly coupled to the first fluid supply conduit upstream of the first hydraulic actuator such that the first flow control valve is configured to control a flow rate of the hydraulic fluid to the first hydraulic actuator;

a second flow control valve defining an adjustable orifice, the second flow control valve being fluidly coupled to the second fluid supply conduit upstream of the second hydraulic actuator such that the second flow control valve is configured to control a flow rate of the hydraulic fluid to the second hydraulic actuator;

a load sense conduit selectively fluidly coupled to the first and second fluid supply conduits, the load sense conduit configured to receive hydraulic fluid from the first or second fluid supply conduit in which the hydraulic fluid is at a greater pressure; and a computing system configured to:

receive a first input associated with a first selected flow rate of the hydraulic fluid being supplied to the first hydraulic actuator;

receive a second input associated with a second selected flow rate of the hydraulic fluid being supplied to the second hydraulic actuator;

control an operation of one of the first or second flow control valve associated with a greater of the first or second selected flow rates such that the one of the first or second flow control valves is at a maximum flow position at which the adjustable orifice has a maximum cross-sectional area;

control an operation of another of the first or second flow control valves based on the first and second selected flow rates; and control an operation of the pump such that the pump supplies the hydraulic fluid to the first hydraulic actuator through the adjustable orifice of the first flow control valve at the first selected flow rate and the second hydraulic actuator through the adjustable orifice of the second flow control valve at the second selected flow rate, wherein when controlling the operation of the pump, the computing system is configured to initiate an adjustment of a pressure of the hydraulic fluid discharged into the first and second fluid supply conduits such that the hydraulic fluid is supplied to the first hydraulic actuator through the adjustable orifice of the first flow control valve at the first selected flow rate and the hydraulic fluid is supplied to the second hydraulic actuator through the adjustable orifice of the second flow control valve at the second selected flow rate.

4. The system of claim 3, wherein, when controlling the operation of the other of the first or second flow control valves, the computing system is configured to control the operation of the other of the first or second flow control valves based on a ratio of the first and second selected flow rates.

5. The system of claim 3, wherein the computing system is further configured to initiate an adjustment to the pressure of the hydraulic fluid within the load sense conduit to control the operation of the pump.

6. The system of claim 5, further comprising:

a pressure-reducing valve fluidly coupled to the load sense conduit, wherein the computing system is further configured to control an operation of the pressure-reducing valve to adjust the pressure of the hydraulic fluid within the load sense conduit.

* * * * *